US005727281A

United States Patent [19]

Harper

[11] Patent Number: 5,727,281

[45] Date of Patent: Mar. 17, 1998

[54] CONE SHAPED MOP WRINGER

[76] Inventor: Robert Harper, 10 Argyle Rd. #14C, Brooklyn, N.Y. 11218-2929

[21] Appl. No.: 502,868

[22] Filed: Jul. 14, 1995

[51] Int. Cl.[6] ..... A47L 13/58

[52] U.S. Cl. ..... 15/260

[58] Field of Search ..... 15/260–263

[56] References Cited

U.S. PATENT DOCUMENTS

| | | | |
|---|---|---|---|
| 2,447,917 | 8/1948 | Strattman | 15/263 |
| 2,465,294 | 3/1949 | Strattman | 15/263 |

FOREIGN PATENT DOCUMENTS

| | | | |
|---|---|---|---|
| 489237 | 6/1992 | European Pat. Off. | 15/260 |
| 383796 | 11/1932 | United Kingdom | 15/263 |
| 162421 | 2/1990 | United Kingdom | 15/263 |

*Primary Examiner*—Mark Spisich

[57] ABSTRACT

A cone shaped mop wringer capable of expelling liquid from different shaped mops such as round and rectangular shapes. The invention is hand held and has a central groove to accept a mop handle therein and a conical shape which facilitates the wringing of the mop fringes. The invention also has at least two side grooves with a bungee cord spanning across functioning to contract the conical mop wringer sides and back members when a rectangular mop is inserted and lifted in an upward direction into the side grooves engaging the bungee cord by simultaneously stretching the bungee cord in an upward direction while contracting the conical mop wringer sides and back members in a squeezing fashion.

10 Claims, 7 Drawing Sheets

CONE SHAPED MOP WRINGER

BACKGROUND OF THE INVENTION

1. Field of the Invention

The present invention relates to cone shaped mop wringers. More particularly, the present invention relates to cone shaped mop wringers capable of wringing out round mops and triangular mops, and capable of drying a mop at varied pressures with no hand to string touching.

2. Description of the Prior Art

Mops are designed to wash and absorb liquid from surfaces such as floors. During use it is necessary to expel the liquid from the absorbative mop fringes. To accomplish this task numerous devices have been invented which manually squeeze the water from the mop fringes. Some of such devices are rectangular in shape capable of expelling water from rectangular (horizontally) shaped mops where as others are cortically and cylindrically shaped to remove water from round shaped mops.

Numerous innovations for mop wringers and squeezers have been provided in the prior art that will be described. However, even though these innovations may be suitable for the specific individual purposes to which they address, they differ from the present invention as herein after described.

For example, U.S. Pat. No. 162,421 to O'Brien, exhibits a one piece non-contracting cone shaped mop wringer housing having a central groove with bucket attachments and/or bucket stabilizing attachments connected thereto capable of expelling water from round shaped mops only. The present invention differs from this invention since it exhibits a hand held self contracting cone shaped mop wringing housing having central groove and two oppositely located spiralling side grooves capable of wringing both round and rectangular (horizontal) shaped mops.

U.S. Pat. No. 5,050,408 to Toupin and U.S. Pat. No. 383,796 to Hess both exhibit a one piece non-contracting diaper wringer exhibiting a central groove mounted within the lid of a bucket. Further having smooth internal and external surfaces which differ significantly from the present invention exhibiting a hand held serf contracting cone shaped mop wringing housing with external non-slip hand grip surfaces and internal water releasing chines. Further having a central groove and two oppositely located spiralling side grooves capable of wringing both round and rectangular (horizontal) shaped mops.

U.S. Pat. No. 3,364,512 to Yamashita et at. describes a mop squeezing cover which slides over mop fringes to expel water. This invention is capable of use on round mops and the cover is integrately attached to the handle of the mop which differs significantly from the present invention having a central grove for detachability to a mop handle during wringing.

U.S. Pat. No. 1,523,751 to Carette describes a manual mop squeezing and wringing device operated by a cranking motion which differs from the present invention which has a self operated squeezing contracting motion in relation to the horizontal mop member due to the upward lifting of the bungee cord which is integrately connected to the left, right and rear conical bodies.

Numerous innovations for mop wringers have been provided in the prior art that are described above. Even though these innovations may be suitable for the specific individual purposes to which they address, they differ from the present invention as hereinabove contrasted.

SUMMARY OF THE INVENTION

The prior art describes mop and diaper wringing devices which differ significantly from the present invention. A mop is designed to wash and absorb liquid from surfaces and require wringing to expel the liquid absorbed therein. Mops are configured in different shapes, two of which being round and rectangular (horizontal). The prior art exemplifies conical shaped mop wringers which are solely capable of wringing round shaped mops whereby the present invention can wring both round and rectangular (horizontal) shaped mops.

Accordingly, it is an object of the present invention to provide a self contracting mop wringer for string mops.

More particularly, it is an object of the present invention to provide self contracting mop wringer manufactured from a single unit made of plastic or plastic composites.

In keeping with these objects, and with others which will become apparent hereinafter, one feature of the present invention resides, briefly stated, in the self contracting mop wringer is that there are no breakable, no detachable parts and it is pliable allowing self contracting.

When the self contracting mop wringer is designed in accordance with the present invention, it may fit variably into the pail and around the mop head.

In accordance with another feature of the present invention, self contracting mop wringer, it is neither attached to the pail or mop handle and is hand held.

Another feature of the present invention is that the self contracting mop wringer is that the contracting motion imparts pressure upon the mop fringes in relation to the distance the mop is pulled in an upward direction. In the case of rectangular mops, the amount of pressure applied is in relation to the lifting in an upward direction of the mop engaging the mop horizontal members within the side grooves and simultaneously stretching a the bungee cord and thus contracting the left, right and rear conical bodies.

Yet another feature of the present invention is that the self contracting mop wringer is light weight.

Still another feature of the present invention is that the self contracting mop wringer is compact.

Yet still another feature of the present invention is that it may be made of polypropelene.

Still yet another feature of the present invention is that is capable of expelling liquid from a mop without any hand contact to the mop fringes.

Another feature of the present invention is that is shaped like a cone with a vertical opening at the top and expanding downwardly and is user friendly and easily cleanable.

Yet another feature of the present invention is that the self contracting mop wringer can wring both round and rectangular shaped mops.

Still another feature of the present invention is that the self contracting mop wringer has a bungee cord circumferentially located spanning the side grooves which when stretched in an upward direction provides an easy means to release the mop from the wringer.

Yet still another feature of the present invention is that the self contracting mop wringer has a conical body top reinforcement ring to strengthen the device while contracting.

In addition, to the above mentioned features, a plurality of liquid releasing chines are positioned within the cone to facilitate the extraction of liquid therein.

Furthermore, non-slip hand gripping means are positioned at the top exterior surface of the cone to prevent slippage during use.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10 - cone shaped mop wringer 10
12 - conical body bottom 12
12A - left conical body 12A
12B - right conical body 12B
12C - back conical body 12C
14A - conical body central groove 14A
14B - conical body left groove 14B
14C - conical body right grove 14C
14D - conical body top opening 14D
14E - conical body bottom opening 14E
16 - bungee cord 16
16A - bungee cord terminal end 16A
18 - chine 18
18A - chine upper slanted surface 18A
18B - chine lower flat surface 18B
20 - bucket 20
22 - mop 22
22A - mop horizontal member 22A
22B - mop fringes 22B
24 - conical body top opening reinforcement ring 24
26 - non-slip hand grip 26

BRIEF DESCRIPTION OF THE PREFERRED EMBODIMENT

FIG. 1 is a front perspective view of the cone shaped mop wringer exhibiting a mop being lifted in an upward direction expelling liquid from the mop fringes into the bucket;

FIG. 2A is a front perspective view of the cone shaped mop wringer exhibiting the central groove through which the mop handle is inserted and the anti-slip hand grip located on the exterior surface of the cone shaped mop wringer, FIG. 2B is a side perspective view of the cone shaped mop wringer exhibiting a spirally configured side groove having a closed top end and a widening open bottom end with an elastic member spanning across the gap;

DETAILED DESCRIPTION OF THE PREFERRED EMBODIMENT

Figure 1:
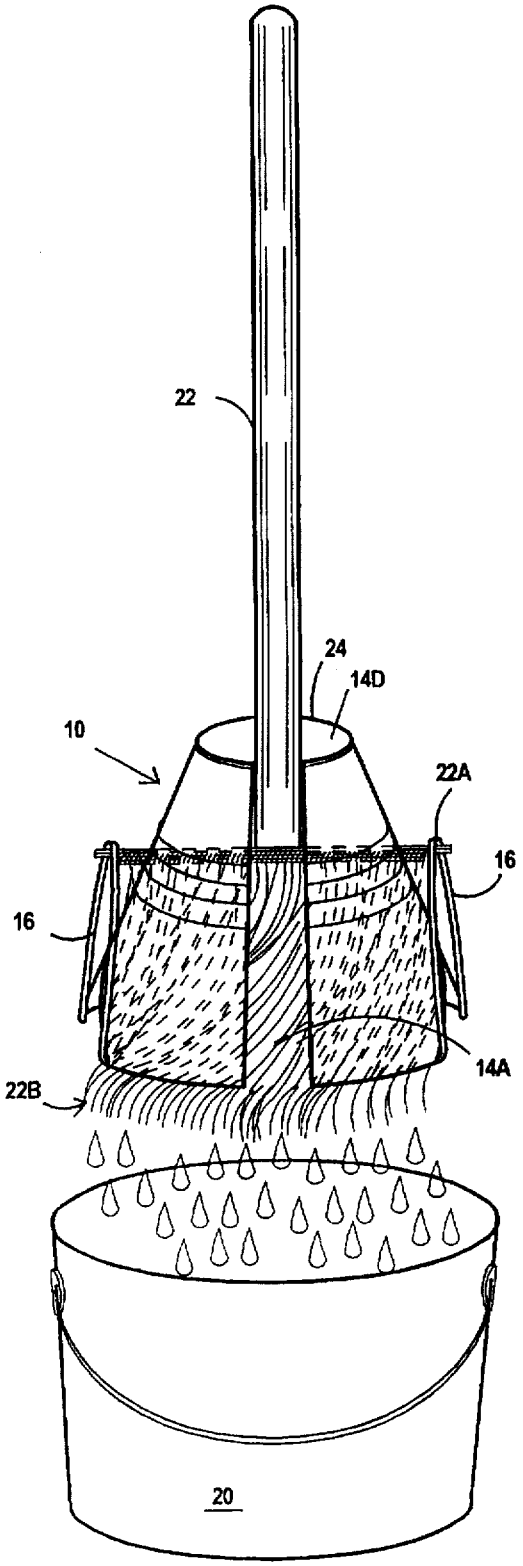

Firstly, referring to FIG. 1 which is a front perspective view of the cone shaped mop wringer 10 exhibiting the following features: left conical body 12A; right conical body 12B; conical body central groove 14A; conical body left groove 14B; conical body right groove 14C; conical body top opening 14D; bungee cord 16; bungee cord terminal end 16A; bucket 20; mop 22; mop horizontal member 22A; mop fringes 22B; conical body top opening reinforcement ring 24; and non-slip hand grip 26. The present invention, cone shaped mop wringer 10, functions to expel water from the mop fringes 22B which are connected to the mop horizontal member 22A when the mop is drawn inwardly into the cone shaped mop wringer 10. A user grips the mop horizontal member 22A by virtue of the non-slip hand grip 26 preventing ones grip from being loosened in the presence of slippery water and soap while wringing the mop 22. The user inserts the mop 22 through the conical body central groove 14A and conical body top opening 14D lifting upwardly until the mop horizontal member 22A engages into the conical body left groove 14B and conical body right groove 14C located at opposite ends at the conical body bottom opening 14E having a bungee cord 16 therebetween. Since the mop horizontal member 22A is larger than the conical body bottom opening 14E, the ends of the mop horizontal member 22A engage the bungee cord 16 which in turn stretches when the mop 22 is lifted upwardly. Concurrently, when the mop 22 is lifted upwardly and the bungee cords 16 are stretched, the left conical body 12A, right conical body 12B, and back conical body 12C are contracted toward each other functioning to squeeze and wring the mop fringes 22B expelling water into the bucket 20. The bungee cords 16 also act to facilitate the downward movement and release of the mop 22 from the cone shaped mop wringer 10 after wringing. The conical body top opening reinforcement ring 24 is located at the top of the cone shaped mop wringer 10 functioning to strengthen the apparatus when the bungee cords 16 contract the left conical body 12A, right conical body 12B, and back conical body 12C toward each other.

Figure 2A:
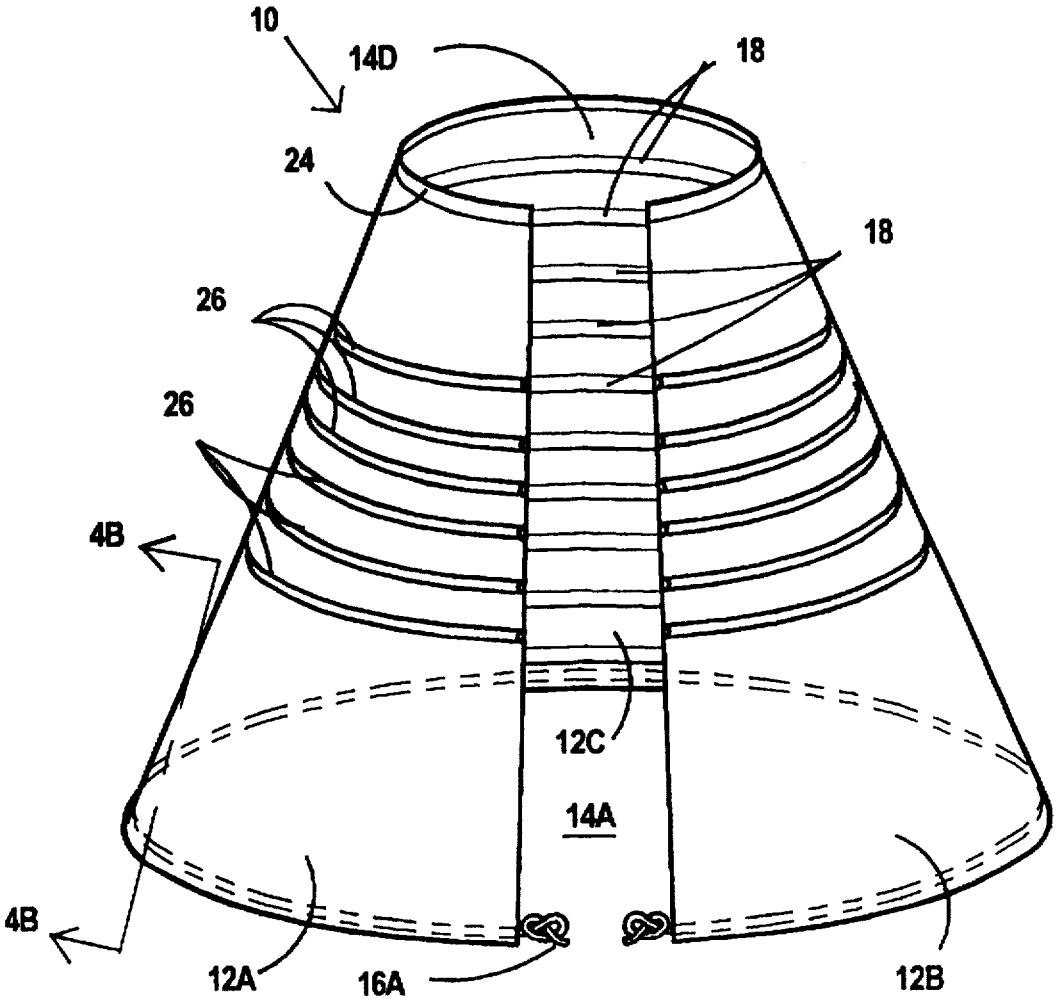

Referring now to FIG. 2A which is a front perspective view of the cone shaped mop wringer 10 exhibiting the following features: The left conical body 12A, the right conical body 12B, and the back conical body 12C; conical body central groove 14A; conical body top opening 14D; bungee cord terminal ends 16A; chine 18; conical body top opening reinforcement ring 24; and non-slip hand grip 26. The bungee cord terminal ends 16A are positioned on the left conical body 12A, and the right conical body 12B at opposite sides of the conical body central groove 14A. The mop 22 is drawn inwardly through conical body central groove 14A and upwardly through the conical body top opening 14D, having a conical body top opening reinforcement ring 24 circumferentially around located at the top end of the conical body central groove 14A. The non slip hand grip 26 is positioned on the top outer surface of the left conical body 12A, the right conical body 12B, and back conical body 12C serving to strengthen the user's hold of the cone shaped mop wringer 10 as the mop 22 is inserted and upwardly drawn through the conical body central groove 14A wringing the mop fringes 22B.

Figure 2B:
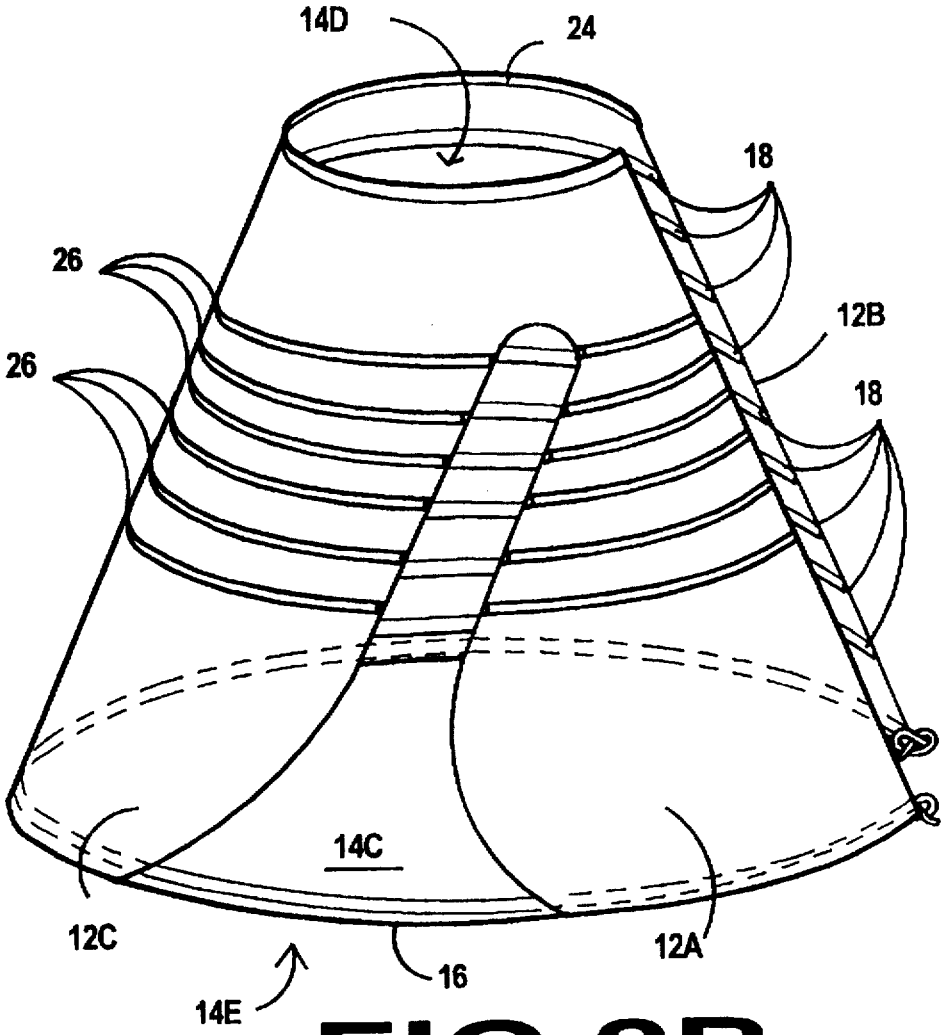

Referring now to FIG. 2B which is a side perspective view of the cone shaped mop wringer 10 exhibiting the following features: left conical body 12A; right conical body 12B; back conical body 12C; conical body left groove 14B; conical body top opening 14D; conical body bottom opening 14E; bungee cord 16; conical body top reinforcement ring 24; non-slip hand grip 26. When a user inserts the mop 22 through the conical body top opening 14D having the conical body top reinforcement ring 24 located circumferentially around, the mop horizontal member 22A simultaneously engages the conical body left groove 14B and conical body right groove 14C thereby engaging the bungee cord 16 on the mop horizontal member 22A top end. When the mop 22 is lifted upwardly, the mop horizontal member 22A engages the bungee cord and stretches it in an upward direction causing the left conical body 12A, the right conical body 12B, and the back conical body 12C to constrict and squeeze excess water from the mop flinges 22B. The constricting action is also facilitated by the spiraling action of the conical body left groove 14B and conical body right groove 14C which facilitates the release of water from the mop fringes 22B. The user holds the cone shaped mop wringer 10 by the non-slip hand grip 26 as the mop 22 is inserted and lifted in an upward direction during use. The distal end of the conical body left groove 14B and conical body right groove 14C are shaped in an outwardly direction, having a larger gap at the bottom than the top to allow for a greater constriction of the left conical body 12A, the right conical body 12B, and the back conical body 12C during constriction and squeezing excess water from the mop fringes 22B

Figure 3A:
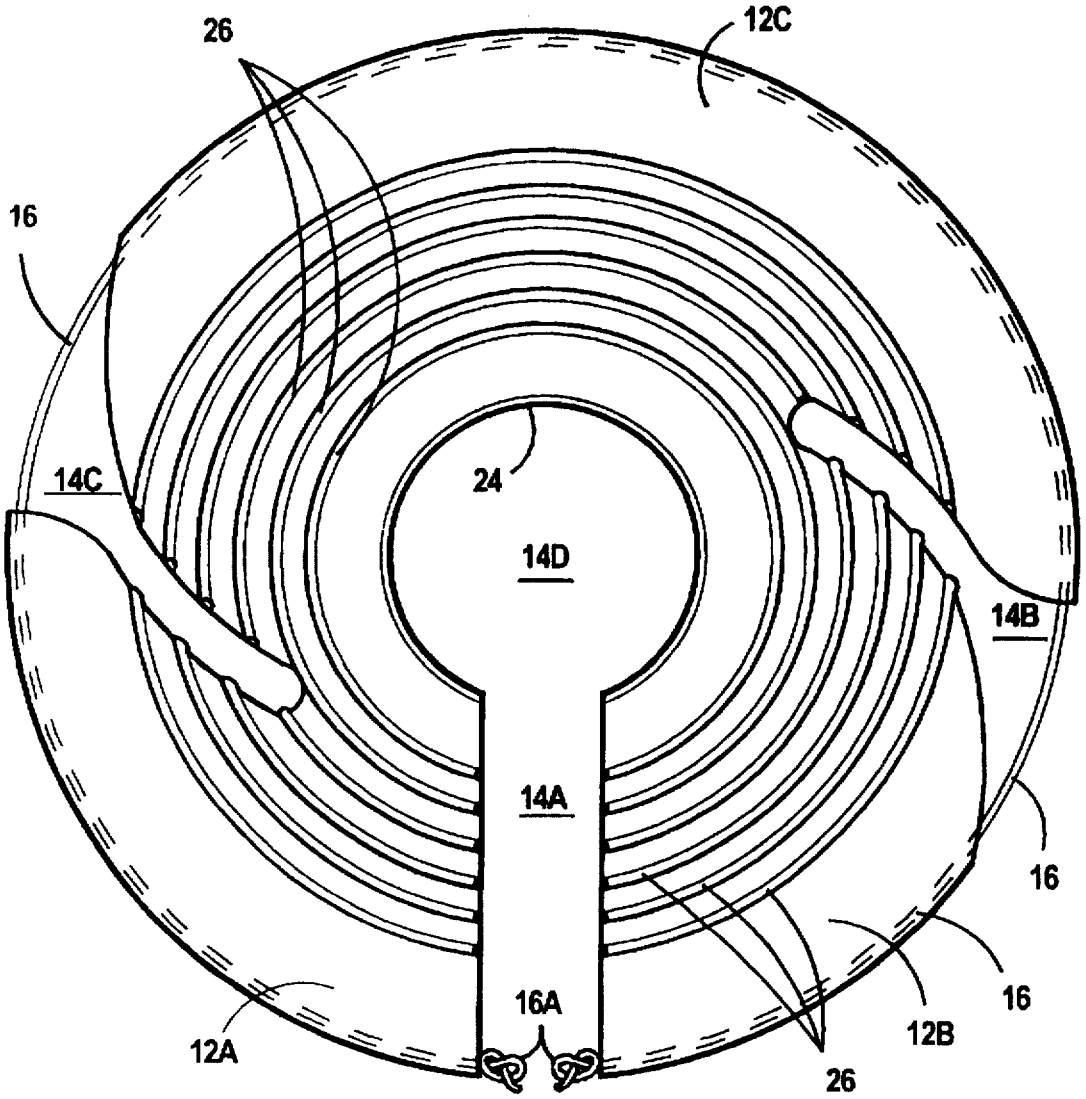
FIG. 3A is a top view of the cone shaped mop wringer exhibiting the anti-slip hand grip surface, spirally shaped side channels with widening bottom ends having the elastic member stretched across the gap, and an open central groove with the elastic member ends terminating therein.

Now Referring to FIG. 3A which is a top view of the cone shaped mop wringer 10 exhibiting the following features: the left conical body 12A; right conical body 12B; back conical body 12C; conical body central groove 14A; conical body right groove 14C, conical body left groove 14B, the conical body top opening 14D; bungee cord 16; bungee cord terminal end 16A; the conical body top reinforcement ring 24; the non-slip hand grip 26. The mop 22 is inserted through the conical body top opening 14D having the conical body top opening reinforcement ring 24 circumferentially located, and the mop horizontal member 22A is engagedly simultaneously inserted into conical body left groove 14B and conical body right groove 14C engaging the bungee cord 16 and causing the left conical body 12A, the right conical body 12B, and the back conical body 12C to constrict when the mop 22 is lifted in an upward direction. The constricting action and water release is increased by the spiral upward movement caused by the spiraling shape of conical body right groove 14C and conical body left groove 14B and causing simultaneous constriction of the left conical body 12A, the right conical body 12B, and the back conical body 12C by virtue of the upward lifting and stretching of bungee cord 16 as the mop 22 is with lifted upwardly, The user holds the cone shaped mop wringer 10 by the non-slip hand grip 26 as the mop 22 is inserted and lifted in an upward direction during use.

Figure 3B:
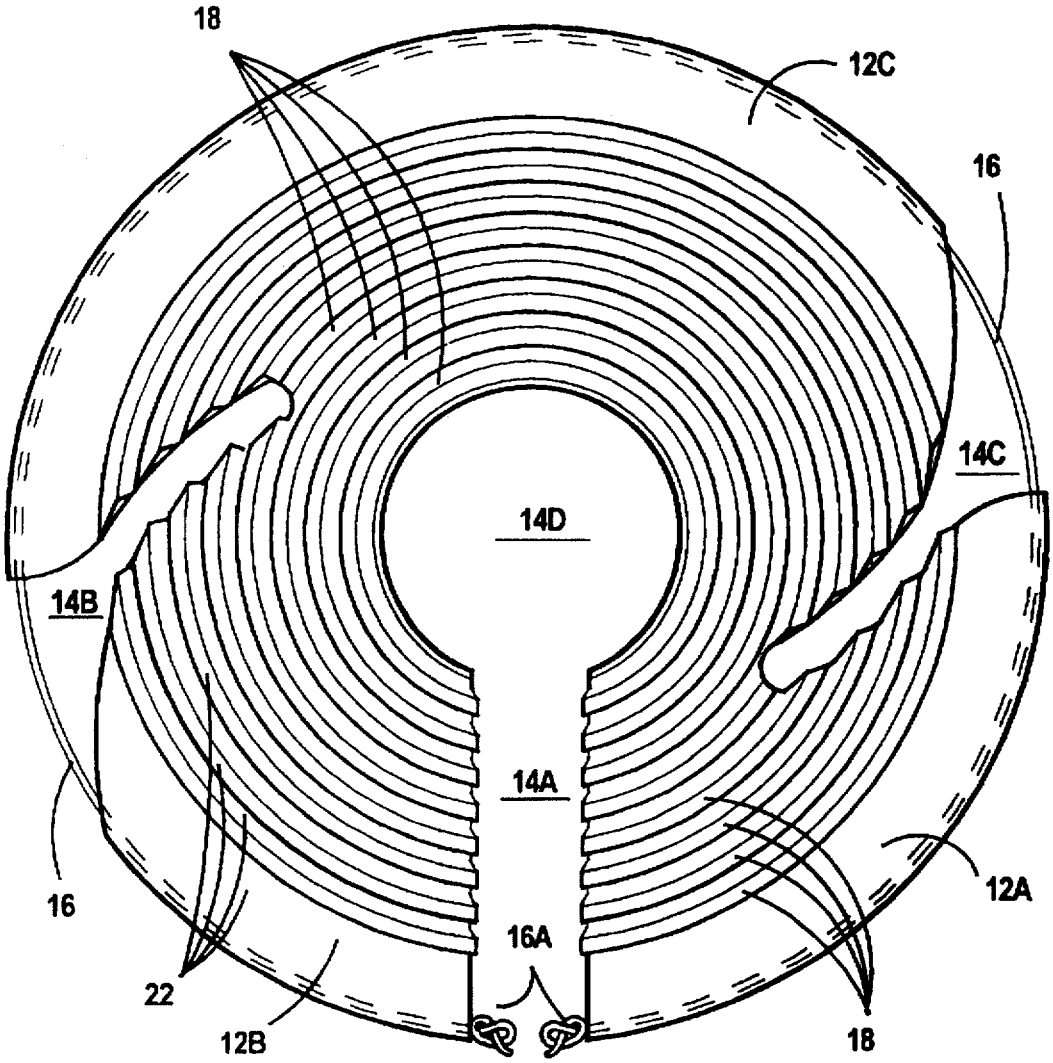
FIG. 3B is a bottom view of the cone shaped mop wringer exhibiting the circumferentially positioned chines on the interior surface.

Referring to FIG. 3B which is a bottom view of the cone shaped mop wringer 10 exhibiting the following features: the left conical body 12A; right conical body 12B; back conical body 12C; conical body central groove 14A; conical body right grove 14C; conical body left groove 14B; the conical body top opening 14D; bungee cord 16; bungee cord terminal end 16A; the conical body top reinforcement ring 24; and chines 18. The mop 22 is inserted through the conical body top opening 14D having the conical body top opening reinforcement ring 24 circumferentially located, and the mop horizontal member 22A is engagedly simultaneously inserted into conical body left groove 14B and conical body right, groove 14C engaging the bungee cord 16 and causing the left conical body 12A, the right conical body 12B, and the back conical body 12C to constrict when the mop 22 is lifted in an upward direction. The constricting action and water release is increased by the spiral upward movement caused by the spiraling shape of conical body right groove 14C and conical body left groove 14B and causing simultaneous constriction of the left conical body 12A, the right conical body 12B, and the back conical body 12C by virtue of the upward lifting and stretching of bungee cord 16 as the mop 22 is with lifted upwardly. Water release is increases by the chines 18 which function to scrape water off of the mop fringes 22B when the spiral upward movement caused by the spiraling shape of conical body right groove 14C and conical body left, groove 14B and causing simultaneous constriction of the left conical body 12A, the right conical body 12B, and the back conical body 12C by virtue of the upward lifting and stretching of the bungee cord 16.

Figure 4A:
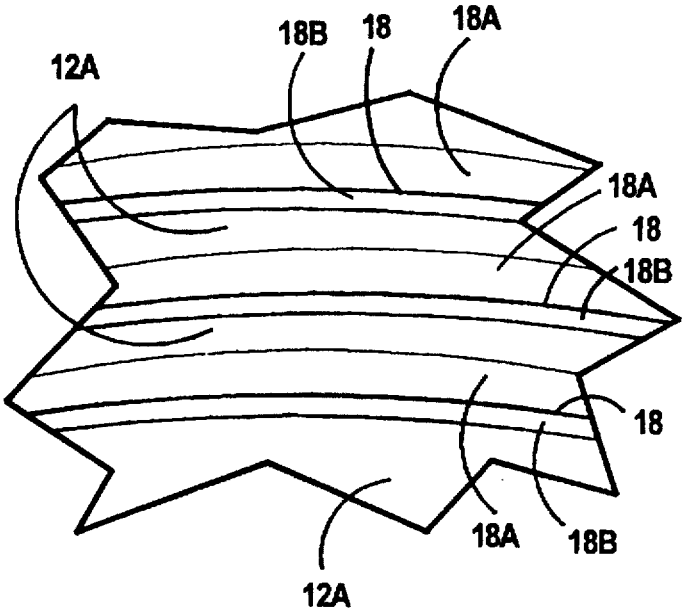
FIGS. 4A and 4B is an enlarged front view and cross-sectional view taken along line 4B—4B, respectively, of the cone shaped mop wringer exhibiting the downward sloped configuration of the chines.
Figure 4B:
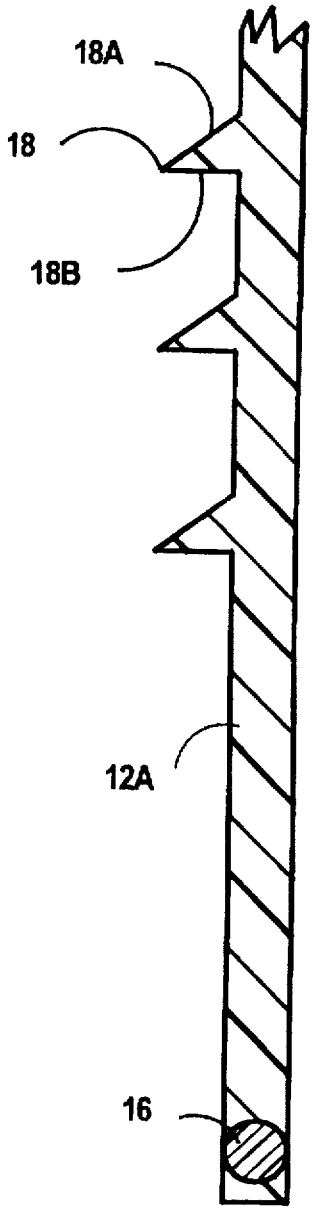

Lastly, referring to FIG. 4A and 4B which is an enlarged front view and cross-sectional view taken along line 4B—4B, respectively, of the cone shaped mop wringer 10 exhibiting the following features: left conical body 12A; chines 18; chine upper slanted surface 18A and chine lower flat surface 18B. Due to the downward angled nature of the chines 18 having chine upper slanted surface 18A in conjunction with chine lower flat surface 18B causes quick release in a downward direction of water from the mop fringes 22B during wringing.

It will be understood that each of the elements described above, or two or more together, may also find a useful application in other types of constructions differing from the type described above.

While the invention has been illustrated and described as embodied in a cone shaped mop wringer, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cone shaped mop wringer for mechanically squeezing a plurality of mop fringes of a rectangular mop having a horizontal member and a handle, comprising:

a) a conically shaped hollow housing having an internal surface, an external surface, a narrow open top and a wide open bottom, said conically shaped housing containing a central longitudinally positioned groove spanning from said narrow open top to said wide open bottom and functioning to accept said handle therein, said conically shaped housing further containing two side grooves functioning to accept said horizontal member of said rectangular mop within said housing, said two side grooves positioned oppositely to one another, one of said two side grooves being positioned to the left of said central groove and the other of said two side grooves being positioned to the right of said central longitudinally positioned groove; and b) elastic retaining means for receiving said horizontal member of said mop when said mop is received by said conically shaped hollow housing, said elastic retaining means being circumferentially positioned around said wide bottom of said housing spanning each of said side grooves and terminating at opposite distal ends within said central groove allowing said central groove to be open without said elastic retaining means spanning across said central groove.

2. The cone shaped mop wringer as defined in claim 1, wherein said retaining means includes a bungee cord.

3. The cone shaped mop wringer as defined in claim 1; further comprising a non-slip hand grip positioned on said external surface of said housing.

4. The cone shaped mop wringer as defined in claim 1; further comprising a plurality of chines positioned circumferentially within the interior of said housing.

5. The cone shaped mop wringer as defined in claim 4, wherein each of said chines has a chine upper slanted surface functioning to expel liquid in a downward direction and a chine lower flat surface functioning to expel liquid from said mop fringes when said mop fringes are pressed and pulled upwardly against said chines.

6. The cone shaped mop wringer as defined in claim 1, wherein each of said side grooves has a dosed top and a wider open bottom and functions to allow maximum contraction of said conically shaped housing.

7. The cone shaped mop wringer as defined in claim 6, wherein each of said side grooves has a spiralling shape so as to provide a cork-screw motion when said horizontal member of said mop is lifted in an upward direction within said side grooves.

8. The cone shaped mop wringer as defined in claim 1; further comprising a conical body top opening reinforcement ring disposed at said narrow open top.

9. The cone shaped mop wringer as defined in claim 1, wherein said conically shaped hollow housing is manufactured from a group of materials selected from a group consisting of plastic, plastic composites, metal, metal alloys, epoxy, fiberglass, carbon-graphite, wood, and rubber.

10. The cone shaped mop wringer as defined in claim 1, wherein said elastic retaining means includes a material selected from a group consisting of rubber, and plastic composites.

* * * * *